US005682767A

United States Patent [19]

De Bussy et al.

[11] Patent Number: 5,682,767

[45] Date of Patent: Nov. 4, 1997

[54] ARGON PRODUCTION

[75] Inventors: Francois De Bussy, Paris, France; Jean-Pierre Tranier, Houston, Tex.

[73] Assignees: Air Liquide Process and Construction, Houston, Tex.; L'Air Liquide, Societe Anonyme pour L'Etude et L'Exploitation des Procedes Georges Claude, Paris, France

[21] Appl. No.: 751,913

[22] Filed: Nov. 18, 1996

[51] Int. Cl.[6] ..... F25J 3/04

[52] U.S. Cl. ..... 62/648; 62/924

[58] Field of Search ..... 62/648, 924

[56] References Cited

U.S. PATENT DOCUMENTS

| | | | |
|---|---|---|---|
| 4,842,625 | 6/1989 | Allam et al. . | |
| 4,983,194 | 1/1991 | Hopkins et al. | 62/924 X |
| 5,426,946 | 6/1995 | Corduan et al. | 62/924 X |
| 5,505,051 | 4/1996 | Darredeau et al. | 62/924 X |

FOREIGN PATENT DOCUMENTS

| | | |
|---|---|---|
| 0446593 B1 | 1/1991 | European Pat. Off. . |
| 5-164462 | of 1993 | Japan . |
| 1416820A | 8/1988 | U.S.S.R. . |

OTHER PUBLICATIONS

Gruber, Wolf, "Recovery of High Purity Argon by Rectification," Industrial Gases Seminar, Jakarta, Sep. 23rd–24th, 1993.

Shinskey, F.G., "Distillation Control for Productivity and Energy Conservation," pp. 61–63, McGraw–Hill, 1977.

*Primary Examiner*—Christopher Kilner

*Attorney, Agent, or Firm*—Robert D. Touslee

[57] ABSTRACT

A process and system for producing an argon-enriched stream comprising a multiple column air separation system, a first crude argon column, and a second crude argon column is provided. The improved process involves removing a vapor stream from the upper portion of the first argon column; reducing the pressure of the vapor in a pressure reducing device; and then flowing the reduced pressure vapor to a second argon column which operates at a lower operating pressure relative to the first argon column.

21 Claims, 2 Drawing Sheets

ARGON PRODUCTION

FIELD OF THE INVENTION

The present invention relates to a process and apparatus for the cryogenic distillation of air using multiple distillation columns to produce argon, nitrogen, and/or oxygen.

BACKGROUND OF THE INVENTION

Argon is a highly inert element, and the recovery and purification of argon for use in many industries is important. Typically, in recovery of argon from air, conditioned air is cooled and fed to a system of multiple distillation columns at cryogenic air separation conditions. Often, a distillation column system including a crude argon, or "argon side arm" column is used wherein a crude argon stream is produced from the double column. This type of process is described in an article by R. E. Latimer entitled "Distillation of Air," published in *Chemical Engineering Progress,* 63(2), pp. 35–59 in 1967.

The volatilities relative to the various gas components leads to an accumulation of argon in the middle section of the low pressure column of the double distillation column. From this point in the low pressure column, an argon enriched gas fraction can be withdrawn for feeding the crude argon column.

It is very important to ensure the stability and control of the flows in and around the side arm argon column. A disruption or excursion in the flow of streams in and around the argon side column may result in a detrimental change within the other columns, which provokes a detrimental change in the product compositions having dramatic consequences.

U.S. Pat. No. 5,019,145 issued May 28, 1991 to Rohde et al. describes a process whereby if is possible to reach very low oxygen concentrations in the crude argon product, when the argon side arm column contains filling bodies or structural packings, and has a high number of theoretical stages.

U.S. Pat. No. 5,426,946 issued Jun. 27, 1995 to Corduan et al. describes the same type of argon side arm column process comprising a high number of theoretical stages, and further describing the argon side column to be split into two column components. The vapor from the first column of the two column crude argon system is flowed directly to the bottom of a second column, operating at the same pressure. The liquid produced in the second column is returned utilizing a pump to the top of the first column of the crude argon system.

U.S. Pat. No. 4,842,625 issued Jun. 27, 1989 to Allam, et al. describes an argon production process wherein a control valve is positioned on the feed to the argon side arm column between the low pressure column of a double column system and the argon side arm column.

Soviet Patent Application No. SU1416820A discloses a two-zone argon side arm column to increase argon purity. The gas from the top of the first zone is warmed, compressed, cooled, and fed to the lower part of the second zone, and a crude argon stream containing a reduced concentration of oxygen is withdrawn from the top of the second zone.

As the crude argon column is a very important component in the overall air separation process, improvements in the efficiency of the argon purification process, and reduction in the cost of equipment to carry out the process is very much desired.

SUMMARY OF THE INVENTION

The present invention is an improvement to the argon production process. In the broadest sense, the invention is a process for producing an argon-enriched stream comprising multiple distillation columns, preferably a double column air separation column, a first crude argon column, and a second crude argon column, wherein a feed stream is removed from the double column and flowed to the first argon separation column, and a vapor stream is removed from the upper portion of the first argon column; and the pressure of the vapor reduced in a pressure reducing device. Thereafter, the reduced pressure vapor is flowed to the second argon column which operates at a lower operating pressure relative to the first argon column.

The present invention also provides a system for recovering argon from a feed air stream comprising multiple distillation columns, preferably a double column distillation system comprising a high pressure and a low pressure column; conduit means for flowing an argon containing stream from an intermediate location of the low pressure column to a first argon column; conduit means for removing an argon-enriched vapor from the upper portion of the first argon column; pressure reducing means for reducing the pressure of the argon-enriched vapor to produce a low pressure argon-enriched vapor; conduit means for flowing the low pressure argon-enriched vapor to a lower portion of a second argon column; and a second argon column which includes means to remove an argon product from the upper portion thereof.

DETAILED DESCRIPTION OF THE INVENTION

Figure 1:
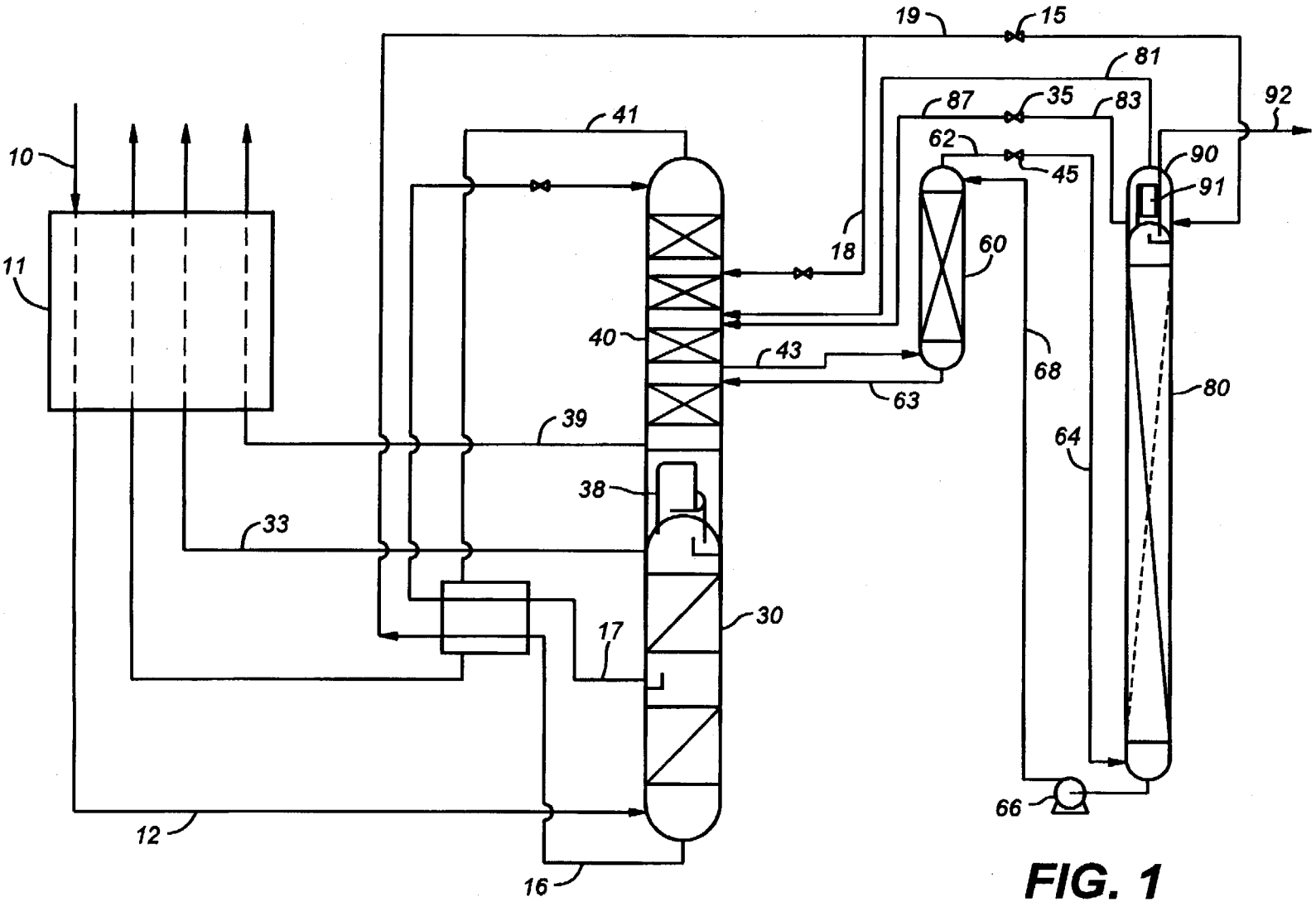
FIG. 1 is a schematic description of the improved process depicting a preferred embodiment of an air separation system, comprising a main double column and a two component crude argon distillation system.

Referring now to FIG. 1, a cleaned and compressed feed air stream 10 is cooled against process streams in a main heat exchanger 11 and thereafter cooled feed stream 12 flows to a feed point of the first air separation column, in this case high pressure distillation column 30. In this preferred embodiment of the present invention, high pressure distillation column 30 is the lower portion of a double column system, and may comprise sieve trays, random ordered packings, or other separation internals, of the type known. The feed air is separated in column 30 to produce an oxygen-enriched liquid, and a nitrogen-enriched portion. The nitrogen-enriched portion is utilized in pad to provide heat to reboiler 38 positioned in the base of low pressure column 40 of the double column system, and a nitrogen-enriched stream 33 is withdrawn from the upper portion of the high pressure column 30 and, following heat exchange in exchanger 11, withdrawn from the system. A stream 17 is withdrawn from an intermediate location in high pressure column 30 and flowed to an upper portion of low pressure column 40 where, following expansion, is flowed into the column 40 for further separation.

In low pressure column 40, oxygen-enriched fraction collects at the bottom where it is vaporized in indirect contact with condensing vapor from the top of column 30, in reboiler/condenser 38. Low pressure column 40 may contain any of the known column internals for cryogenic distillation, including random packings or sieve trays. A stream 39 is withdrawn from the lower portion of the low pressure column 40 and, following heat exchange in exchanger 11, removed from the system. A vapor fraction rich in nitrogen 41, is removed from the upper portion of low pressure column 40 and, following heat exchange, is removed from the system. Due to the relative volatilities of oxygen, argon, and nitrogen, the argon concentration is highest in a intermediate location between the upper and lower portion of low pressure column 40.

In accordance with the present invention, an argon containing stream 43 is withdrawn from an intermediate location of the low pressure column, and flowed to a first argon distillation column 60. A return stream 63 lean in argon relative to feed stream 43 is returned to an intermediate location of the low pressure column 40, preferably the same stage as feed stream 43 is withdrawn. First argon column 60 may contain any vapor fluid contacting devices, preferably ordered packing. From the upper portion of the first argon column 60, an argon-enriched vapor stream 62 is withdrawn.

In accordance with the present invention, the vapor stream 62 is reduced in pressure across a pressure-reducing device 45 located in the vapor flow line between vapor stream 62, and relatively lower pressure vapor stream 64, prior to feeding a lower portion of a second argon column 80. The second argon column 80 operates at a lower relative pressure to the first crude argon column 60. Preferably, the pressure differential between the top of the first argon column and the bottom of the second argon column is between about two and about fifteen percent, preferably between two and about ten percent, of the absolute pressure of the top of the first argon column.

By the foregoing term "lower relative pressure," it is meant a pressure in the bottom of the second argon column lower than the pressure in the top of the second argon column. Among other advantages, because of such lower relative pressure to column 60, the first argon column 60 may be constructed with a reduced cross-sectional area, up to about 15% less overall cross-sectional area, due to the higher operating pressure, as compared to operating the first argon column at the same low pressure as the second argon column. Moreover, at the higher relative operating pressure, the first crude argon column 60 may be placed at a lower elevation within the cold box enclosure containing all of the columns operating at cryogenic temperatures, while retaining the ability to flow liquid from the bottom of column 60 to the liquid return point in column 40 via line 63. Such lower elevation is significant, for among other factors, it minimizes the overall total height of the cryogenic cold box enclosure. Not only does such overall limitation and height reduce the amount of metal and associated fabrication, but also the structural foundation and other construction considerations which must be accounted for in the installation of tall structures. The height of column 60, along with base of column 30, or 80, determines the overall height of the cold box enclosure. Therefore, any reduction in the elevation of column 60 reduces the overall cold box height.

Lower relative pressure feed stream 64 is separated into an argon-rich component at the top, and an oxygen-rich component at the bottom of column 80. The bottom liquid is flowed to the top of higher pressure column 60 via line 68. Due to the negative elevation difference, a pump 66 is preferably utilized required to return the liquid to column 60. Column 80 may contain any type of vapor liquid contacting devices, preferably ordered packings. At the top of lower-pressure column 80, argon-rich vapor is condensed, at least partially, in condenser 91 by indirect heat exchange against a process stream, preferably an oxygen-rich stream from the bottom of the main distillation column 30. In the preferred embodiment, a portion of the oxygen-enriched bottom from high pressure column 30 may be flowed to an intermediate location in low pressure column 40, as depicted by line 81. In this case, condensed oxygen-rich liquid accumulates in the bottom of the head portion 90, and is flowed via line 83 across optional control valve 35 and return to the low pressure column 40 at an intermediate location via line 87. A vapor portion is removed from the head condenser 90 and flowed via line 81 to an intermediate location in low pressure column 40. An argon-rich product is removed from the condenser 91 and from the system via line 92.

Figure 2:
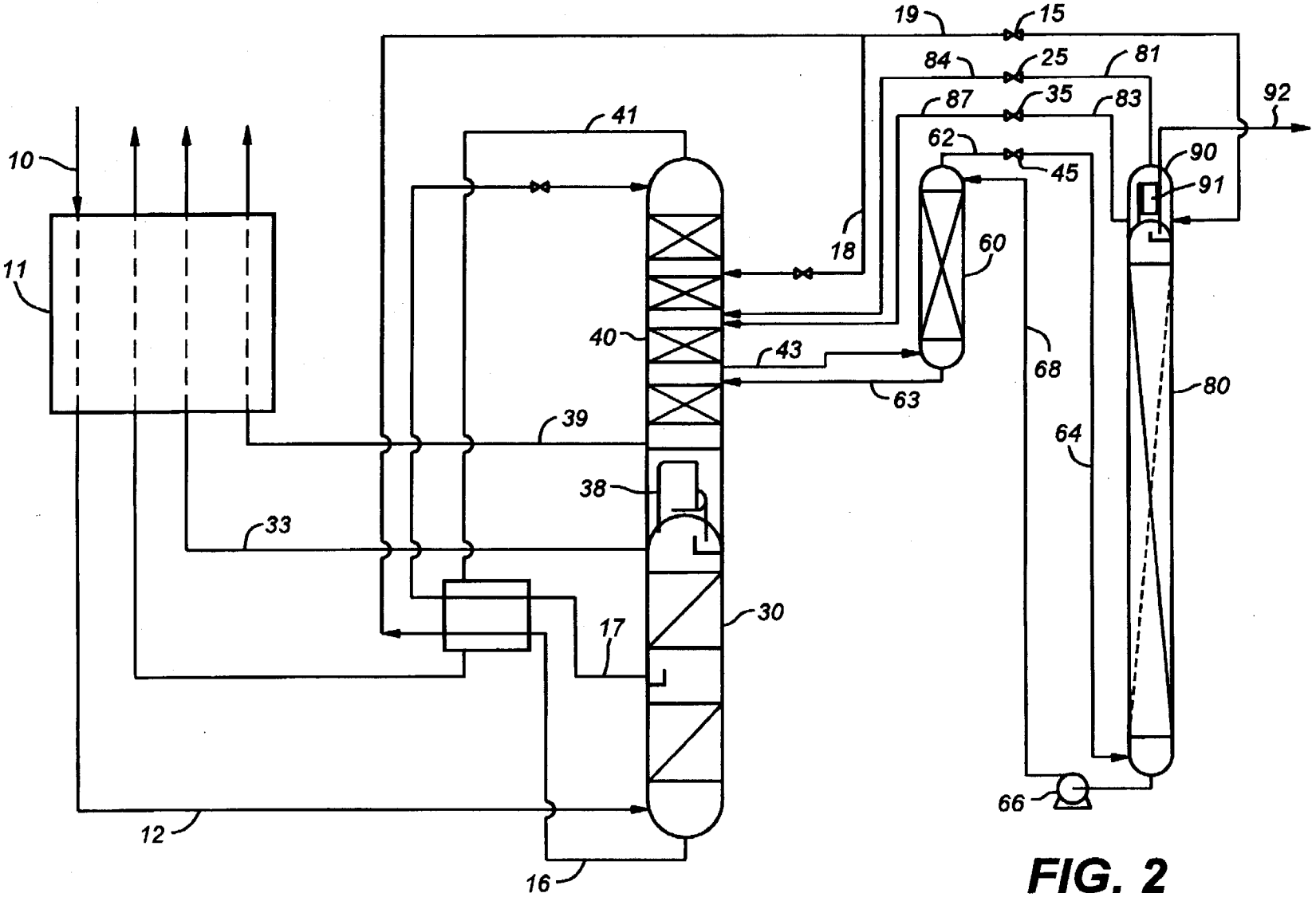
FIG. 2 is another embodiment depicting the improved argon recovery process including controlling the vapor flow return to the main double column.

Referring now to FIG. 2, wherein another embodiment is depicted, an optional control valve 25 is placed in the vapor line from the head condenser 90 to control the flow of vapor, and therefore the rate of heat exchange in the condenser 91. Control valve 25 may be operated together with the pressure reducing device, which is preferably a control valve 45, using a process controller, to achieve an improved and highly regulated performance in the distillation system comprising columns 60 and 80.

In accordance with the present invention, the difficult argon/oxygen separation occurring in the column is improved, relative to that separation which would occur if the column 80 were operated at a pressure other than the relative lower pressure relative to column 60.

We claim:

1. In a process for producing an argon-enriched stream utilizing a multiple column air separation system, a first argon column, and a second argon column, the improvement comprising (a) removing from the double column a feed stream to said first argon column, (b) removing a vapor stream from the upper portion of said first argon column;

(c) reducing the pressure of the vapor in a pressure reducing device; and (d) flowing the reduced pressure vapor to said second argon column which operates at a lower operating pressure relative to said first argon column.

2. A process for the production of an argon product comprising (a) removing an argon-containing stream from a column of a multiple column air separation system and flowing said argon-containing stream to a first argon column;

(b) removing an argon-enriched vapor from an upper portion of said first argon column, and reducing the pressure of said argon-enriched stream in a pressure reducing device to produce a reduced pressure argon-enriched vapor;

(c) flowing the reduced pressure argon-enriched vapor to a second argon column which operates at a lower pressure relative to said first argon column; and (d) removing an argon product from an upper portion of said second argon column.

3. A process according to claim 2 wherein said multiple air separation is a double column system comprising a intermediate pressure column and a low pressure column.

4. A process according to claim 2 wherein at least one of said first or said second argon column contains structured packings.

5. A process according to claim 2 wherein both of said argon columns contain structured packings.

6. A process according to claim 2 wherein said argon product is removed as a liquid.

7. A process according to claim 2 wherein said argon product is removed as a gas.

8. A process according to claim 2 wherein prior to removal, said argon product is condensed by indirect heat exchange against another process stream.

9. A process according to claim 8 wherein said another process stream comprises an oxygen-enriched stream from said double column.

10. A process according to claim 8 wherein the rate of said heat exchange is controlled by controlling the flow rate of said another process stream following said heat exchange with said argon product.

11. A process according to claim 10 wherein said pressure reducing device is a flow control valve which controls said argon-enriched vapor stream to said second argon column, and said flow rate of said another process stream is determined from said argon-enriched vapor stream.

12. A system for recovering argon from a feed air stream comprising (a) a multiple column distillation system comprising a high pressure and a low pressure column;

(b) a first argon column;

(c) conduit means for flowing an argon containing stream from an intermediate location of said low pressure column to said first argon column;

(d) conduit means for removing an argon-enriched vapor from an upper portion of said first argon column;

(e) pressure reducing means for reducing the pressure of said argon-enriched vapor to produce a lower relative pressure argon-enriched vapor;

(f) conduit means for flowing said lower relative pressure argon-enriched vapor to a lower portion of a second argon column;

(g) means to remove an argon product from an upper portion of said second argon column.

13. A system according to claim 12 wherein said multiple column distillation system is a double column system wherein feed for said low pressure column is derived from the lower portion of said high pressure column.

14. A system according to claim 12 wherein at least a portion of one of said argon columns contains structured packings.

15. A system according to claim 12 wherein both of said argon columns contain structured packings.

16. A system according to claim 12 wherein said pressure reducing means is a flow control device.

17. A system according to claim 16 further comprising indirect heat exchange means in fluid contact with said argon-enriched vapor at an upper portion of said second argon column.

18. A system according to claim 17 further comprising conduit means to flow an oxygen-enriched stream from said double column to said indirect heat exchange means and conduit means to return at least a portion of said oxygen-enriched stream to said system.

19. A system according to claim 18 further comprising flow control means located in said conduit means for flowing said oxygen-enriched stream to said heat exchange means, or in said conduit means for flowing said oxygen-containing stream from said heat exchange means.

20. A system according to claim 19 wherein said pressure reducing means is flow control means.

21. A system according to claim 20 further comprising process control means to operate said flow control means for said oxygen-enriched stream and said flow control means for said argon-enriched vapor.

* * * * *